United States Patent [19]

Sochard

[11] 4,269,121

[45] May 26, 1981

[54] SEMI-ACTIVE OPTICAL FUZING

[75] Inventor: Irving I. Sochard, Chevy Chase, Md.

[73] Assignee: The United States of America as represented by the Secretary of the Navy, Washington, D.C.

[21] Appl. No.: 929,595

[22] Filed: Jul. 31, 1978

Related U.S. Application Data

[63] Continuation-in-part of Ser. No. 497,368, Aug. 12, 1974, abandoned.

[51] Int. Cl.[3] ..... F42C 13/02

[52] U.S. Cl. ..... 102/213

[58] Field of Search ..... 102/213, 214, 211; 244/3.13, 3.16, 3.14, 3.19

[56] References Cited

U.S. PATENT DOCUMENTS

| | | | |
|---|---|---|---|
| 3,136,251 | 6/1964 | Witow | 102/213 |
| 3,485,461 | 12/1969 | Katsanis | 102/213 |
| 3,621,784 | 11/1971 | Mundie et al. | 102/213 |
| 3,741,111 | 6/1973 | Brenner | 102/213 |
| 3,743,216 | 7/1973 | Salonimer | 244/3.16 |
| 3,761,180 | 9/1973 | Maxwell, Jr. et al. | 244/3.16 |
| 3,843,076 | 10/1974 | King et al. | 244/3.16 |
| 3,844,506 | 10/1974 | Stavis et al. | 244/3.19 |
| 4,091,412 | 5/1978 | Salonimer | 244/3.16 |

*Primary Examiner*—Charles T. Jordan

*Attorney, Agent, or Firm*—R. S. Sciascia; A. L. Branning; R. E. Bushnell

[57] ABSTRACT

Device for causing projectiles to detonate at the optimum point along their individual trajectories when fired at nearly any type of target. Detonation at this point will result in the greatest damage to the intended target.

31 Claims, 14 Drawing Figures

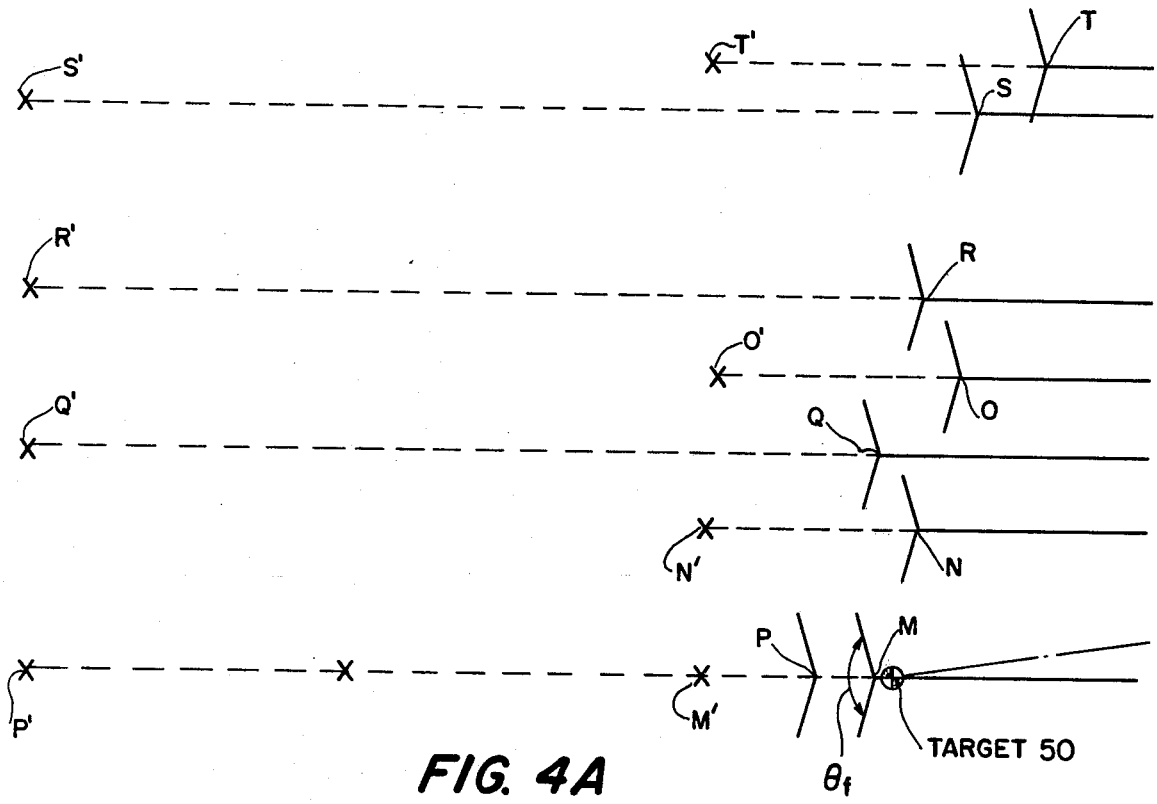
FIG. 4A
FIG. 4B
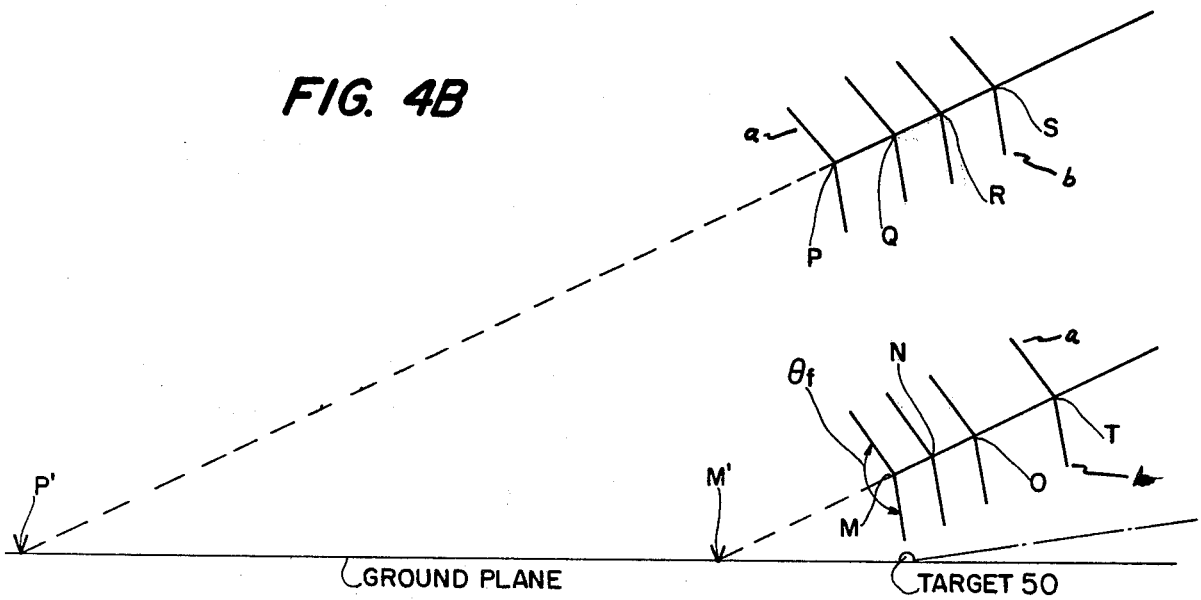

SEMI-ACTIVE OPTICAL FUZING

CROSS REFERENCE TO RELATED APPLICATIONS

This reference makes references to my earlier filed application, Ser. No. 497,368, filed on Aug. 12th, 1974, and is a GI-P, now abandoned, for the purpose of obtaining the benefits specified under 35 U.S.C. 120.

BACKGROUND OF THE INVENTION

Most high explosive fragmentation projectiles are anisotropic in their fragmentation pattern. In terms of a coordinate system where the forward direction of the projectile is designated 0° and the rear direction 180°, zones of constant angle will usually have a constant average fragmentation density when averaged over many detonations of the same type of shell. The zone of maximum fragmentation density will usually occur at or near 90° for stationary or slow moving projectiles. For a fast moving projectile the forward velocity of the projectile will add vectorially to the predominantly sideward velocity of the explosive force resulting in the zone of densest fragmentation being swept forward to form an annular cone with a half angle of typically 30° to 60° for various types of shells. This zone will typically have a fragmentation density 5 to 12 times greater than the average fragmentation density. This is so whether the density is measured in weight of fragments per steradian or number of fragments per steradian. This zone (Z max) typically about 10° wide may contain about half of the total fragmentation yield of the projectile. An optimum fuzing method is one in which detonation is made to occur so that Z max will consistently impact the desired target. Existing types of optimum fuzing have attempted to define the optimum plane above the target at which detonation of a salvo of fragmentation projectiles will place the densest part of the fragmentation pattern at the target. An example of an existing optimum fuze is an anti-aircraft fuze which uses a infrared detector with an annular field of view matched to the Z max angle for the expected encounter scenario. This fuze will detect the hot exhaust of the jet engine and detonate the shell at the optimum time. This is a passive optimum I.R. fuze. Another example of an optimum fuze is a microwave fuze which is used to dentoate a shell when its target is at an optimum angle. This is an active optimum microwave fuze. Both these types of optimum fuzes depend on a detector in the projectile identifying the target as well as indicating the optimum angle. Their use however, is limited to targets which are uniquely different from the environment in some easily characterizable way such as, for example, targets having strong I.R. sources or having high R.F. reflectivity. Although most targets do not display such characteristics, the prior art fuzes found wide use and, when used, some have displayed reliable accuracy.

SUMMARY OF THE INVENTION

The present device overcomes the disadvantages and limitations of the prior art by providing a semi-active optical fuzing device. The device causes individual projectiles to detonate at the optimum point along their trajectory when fired at nearly any type of target. Detonation at the optimum point results in the greatest damage to the target. The fuze incorporates an annular field of view matched to the Z max zone and responds to the diffuse reflection off the target of a designating optical beam. The sensitivity of the detector need only be great enough to sense this reflection out to the maximum damage radius of the projectile, usually some tens of yards.

It is therefore the object of the present invention to provide an improved semi-active optical fuzing system.

It is also an object of the device to provide a reliable and inexpensive semi-active optical fuzing system.

Another object is to provide an accurate semi-active optical fuzing system.

Another object is to provide a semi-active optical fuzing system which can be generally used with a wide range of targets.

Yet another object is to provide a semi-active optical fuze, allowing for detonation of a projectile at the optimum point along its trajectory.

A further object is to provide a semi-active optical fuze allowing for detonation of a projectile at the optimum point along its trajectory to a target that is optically similar to its environment.

A more complete appreciation of this invention, and many of the attendant advantages thereof, will be readily enjoyed as the same becomes better understood by reference to the following detailed description when considered in conjunction with the accompanying drawings in which like numbers indicate the same or similar components wherein:

FIG. 4A is a top view of one-half of the target plane, showing the trajectories of eight projectiles.

FIG. 4B is a side view taken along a vertical plane normal to the ground plane, showing the trajectories of the eight projectiles shown in FIG. 4A.

DETAILED DESCRIPTION OF THE INVENTION

Figure 1:
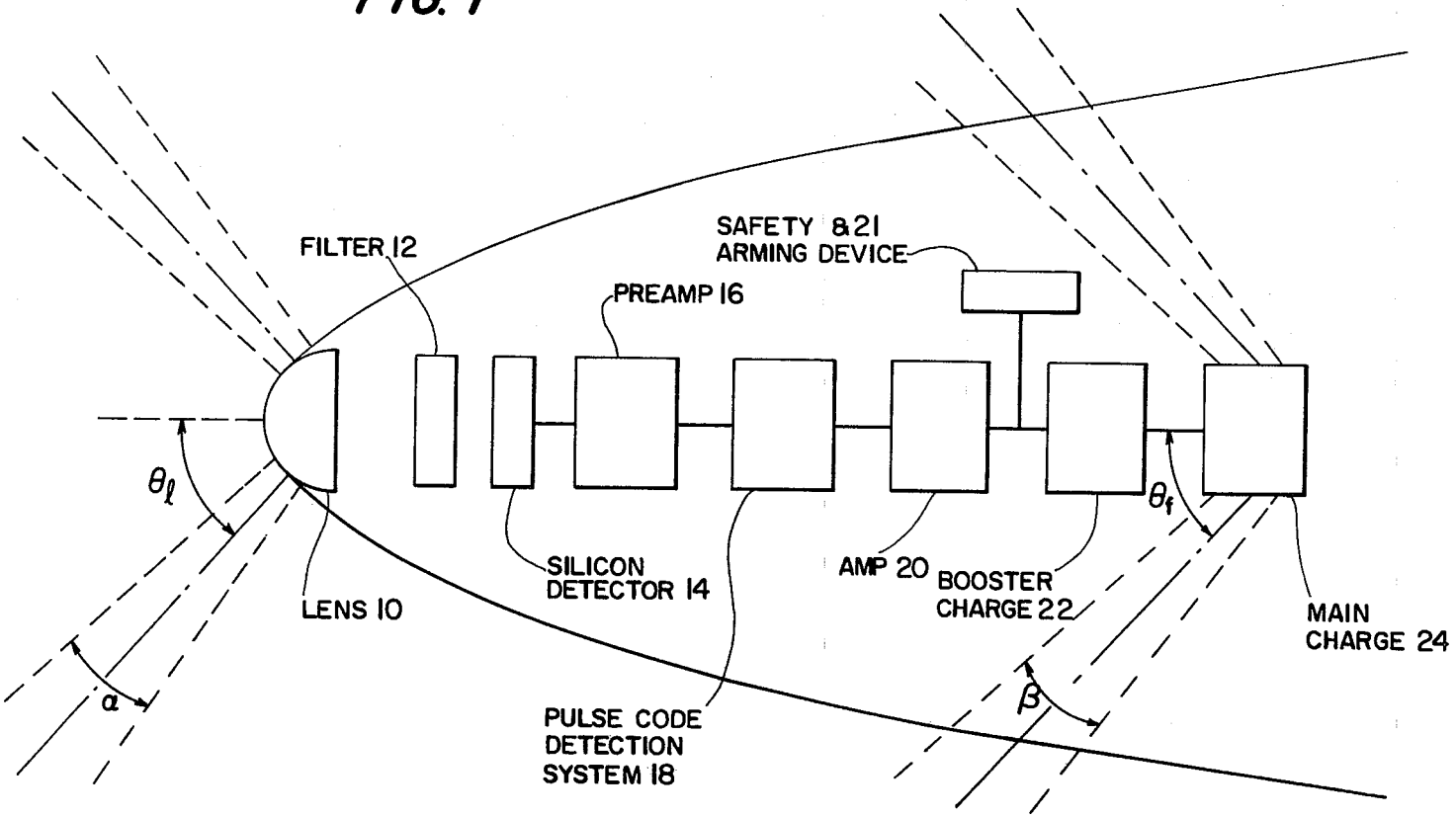
FIG. 1 is a diagrammatic side view of the fuze and shell components of one embodiment.

FIG. 1 discloses the elements of the fuze in projectile 1 of an embodiment. The fuze consists of a lens 10 and filter 12 combination mounted in the nose of the projectile to focus an image on a ring (annular) detector 14 mounted behind the filter 12 on the focal plane. The filter 12 is needed to remove unwanted light at wave lengths other than that of the designator laser of FIG. 2. Excess background light may overload the detector 14 or generate excessive noise if not removed. The most practical detector material for use in conjunction with the suggested lasers is silicon. The pulsed laser light scattered off the target will, when the projectile is in the optimum position, fall on the detector 14 and generate a pulsed electrical signal. This pulsed output signal from the detector is then amplified in a low noise amplifier 16. It is then sent to a pulse code recognition circuit 18 needed to screen against sun glint or attempted countermeasures. If the pulses match the required code, they are then sent through a safety and arming device 21 to an explosive triggering circuit 22.

In the 105 millimeter fragmentation projectile the speed of impact is usually about 900 feet per second, plus or minus 100 feet per second. The velocity of the fragments, at detonation, is about 3400 feet per second along a normal to the trajectory of the projectile. To provide a dense fragmentation pattern around the target area 50, an embodiment of the present invention should have an annular field of view with a centerline subtending an angle $\theta_1$ of 75° 53′, a value equal to the angle $\theta_f$ subtended by the centerline of the fragments. The angular width, $\alpha$, of the field of view, to compensate for the variations in the speed of impact, is about 3° 16′, a value about equal to the angular width, $\beta$, of the spread of projectile fragments.

Figure 1A:
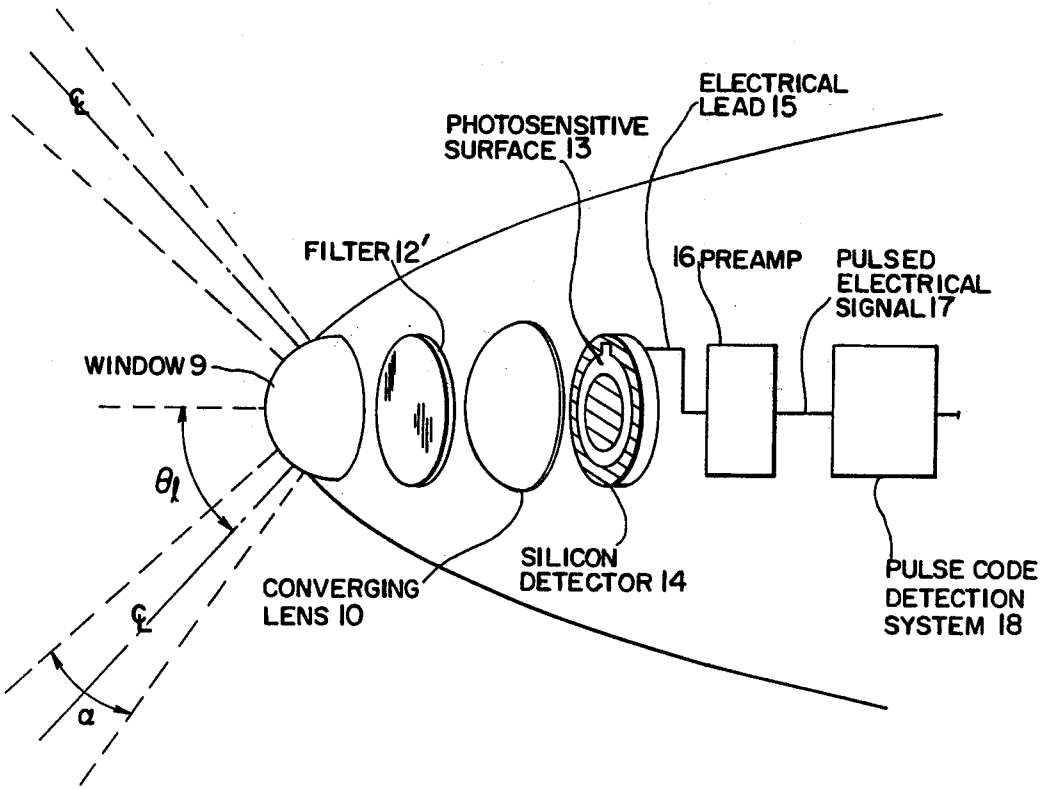
FIG. 1A is an exploded view of an alternate embodiment of the optical components in a projectile.

FIG. 1A shows the optical components of an alternate embodiment. The window 9 is fixed in the nose of projectile 1 in combination with one or more filters 12′ and a plano-convex silicon dioxide lens 10, to focus an image on the annular photo-sensitive surface 13 of detector 14. The detector 14 is mounted coaxially with windows 9, filter 12′, and lens 10, on the converging side of lens 10 at the focal plane. The principal axis of lens 10 is coaxial with the longitudinal axis of projectile 1; in flight the principal axis is tangential to the trajectory of projectile 1. The detector 14 and lens 10 combination provide an annular field-of-view describable as the circumference formed by the intersection of a conic surface and a plane (e.g., the ground plane). When the projectile is close enough to its potential point of impact 48 for detector 14 to discern the illumination reflected from target 50, the image formed at the focal plane will be inside the annular photosensitive surface 13. As the projectile continues on its trajectory, the image will move away from the center of, and towards, annular surface 13. Detonation will occur when, or just after, the image crosses the inner circumference of photosensitive surface 13.

If an adaptive system is required, this can be achieved by the use of a zoom lens automatically preset to the focal length that will give the proper optimum angle for the expected target encounter velocity. For advanced types of warheads which do not produce a continuous ring of fragments about their axis such as the strip frag or the polygon warhead, optimum fuzing can be achieved by using a pattern consisting of detector dots placed in a circle at the optimum radius.

Figure 2:
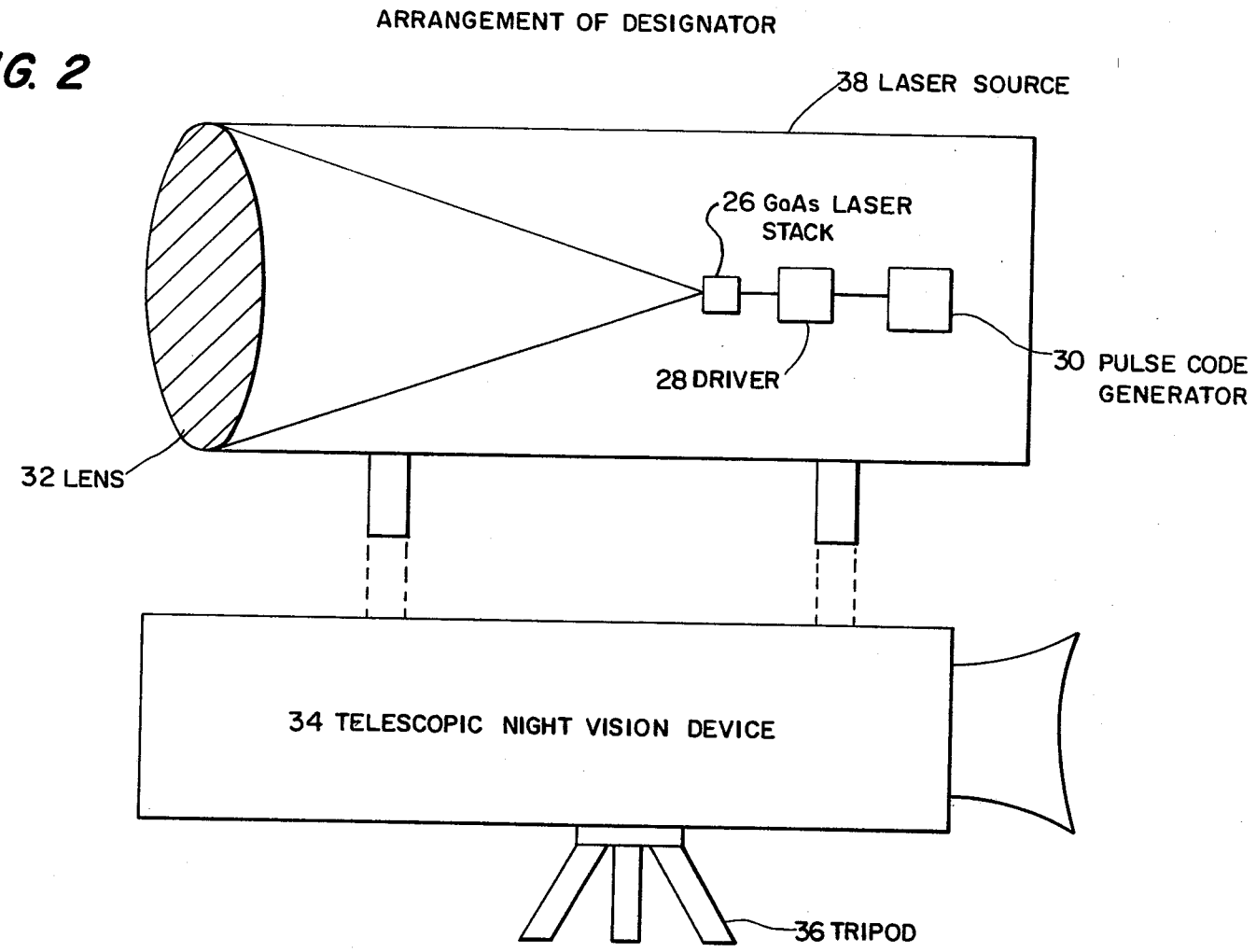
FIG. 2 is a diagrammatic side view of the designator of one embodiment.

The designator of FIG. 2 comprises a pulsed laser source 38 and the required optics to form a tightly focused beam. Practical lasers for this purpose at the present are gallium arsenide or other laser diodes for small units for applications up to a few kilometers or acoustically Q-switched neodymiun units for horizon limited applications. The laser 38 must be pulsed at a rate of at least several kilohertz in most applications so that the projectile's detector as shown in FIG. 1 can sense the reflection and trigger a detonation in the few milliseconds the projectile will be in the optimum position. Pulsing is achieved by way of a pulse code generator 30 which activates a driver 28 which, in turn, activates a laser stack 26. A lens 32 is used to focus the laser beam emitted from the laser source 38. Also shown in FIG. 2 is a telescopic night vision device 34 mounted on a tripod 36 to which said laser source 38 is connected. The telescopic night vision device is used by the designator operator to aim the laser source 38 at the target both at night and at long distances.

Figure 3:
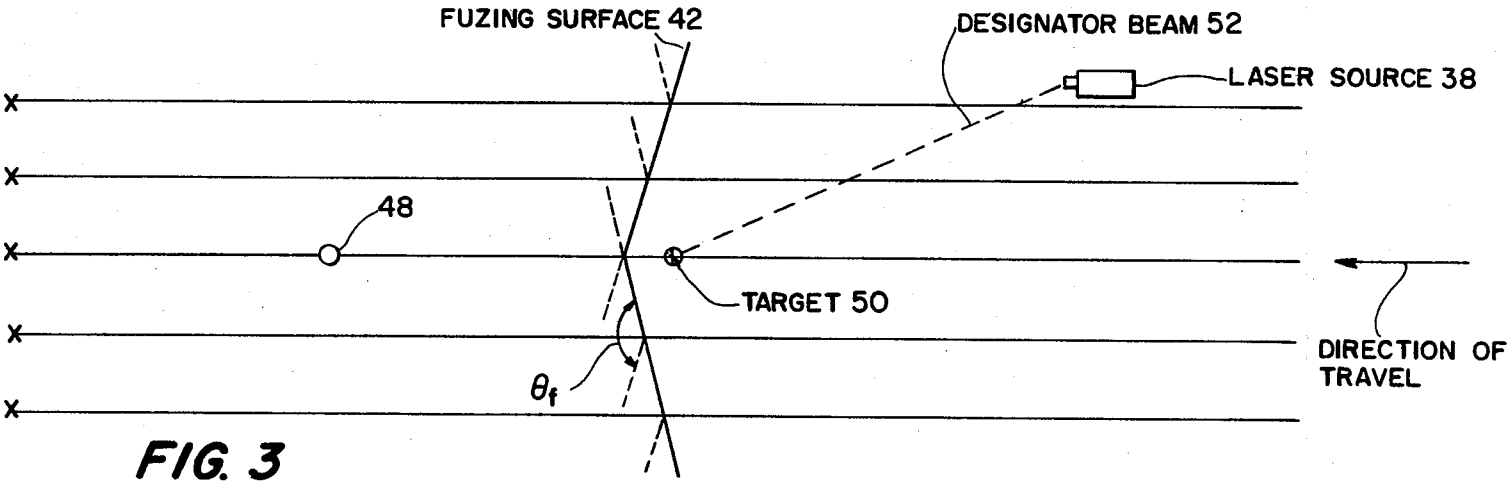
FIG. 3 is a top view of the flight paths of the projectiles.
Figure 4:
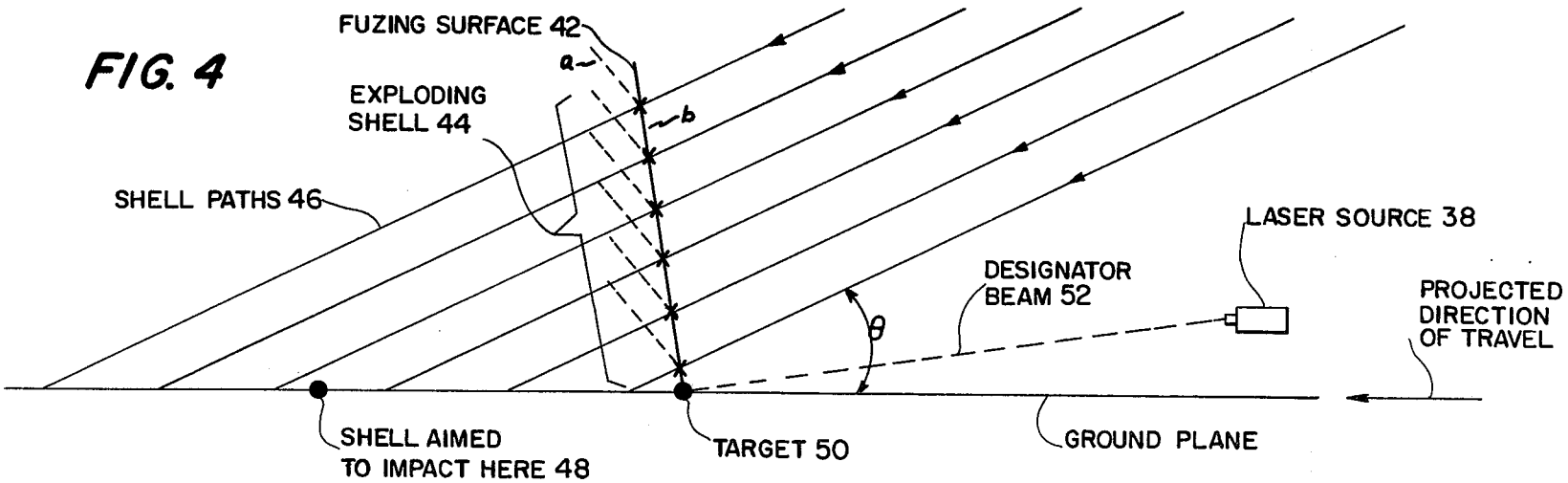
FIG. 4 is a side view of the flight paths of the projectiles.

FIGS. 3 and 4 show the manner of operation of the system. As shown therein, the designator beam 52 is pointed at the intended target 50 such that radiation is emitted from the target. Note that in FIG. 3 the five projectiles are shown transversing parallel trajectories along a plane oblique to the ground, while in FIG. 4 a different salvo of six projectiles are shown transversing parallel trajectories along a plane normal to the ground plane. Due to the inaccuracy of the cannon from which projectiles are likely to have been launched, it is unlikely that the trajectories of several projectiles in a salvo would lie in a single plane. The shells are aimed at a point 48 past the target 50 so that when they reach the fuzing surface 42, their detectors sense the reflections of the designator beam 52 and are caused to detonate. Since the optics of the projectile fuze have an optically annular field of view, the projectile is detonated at its optimum position. An important modification may be required if the relative projectile target velocities are subject to side variations such as in an anti-aircraft system which is required to fire at high speed aircraft from different aspects. In such a case the required optimum angle Z max will be an important function of the relative velocity. To use the described fuze against such targets, the aspects angle of the annular field of view must be adjustable (or adaptive). This, again, could be controlled through the use of a zoom lens as described above.

Refer now to FIG. 4A, a top view of a half target plane around illuminated target 50, showing the trajectories of eight projectiles. FIG. 4B is a side view of the same target plane showing the same eight trajectories. The trajectories of four of the projectiles describe a plane oblique to the ground plane and parallel to another plane described by the remaining four projectiles. Note that the eight trajectories shown are idealized for purposes of illustration; in practice any correspondence between the trajectories and points of impact of the projectiles in the same salvo is fortuitous. The points of potential impact P', Q', R', and S' of the four projectiles transversing the upper plane describe a straight line, as do the potential points of impact M', N', O', and T' of the four projectiles transversing the lower plane. The points of detonation, P, Q, R, and S of the four projectiles transversing the upper plane describe a line oblique to both their trajectories and to the line described by their potential points of impact; the points of detonation M, N, O and T of the four projectiles transversing the lower plane describe a similar line; both lines described appear to be parallel lines. Note than in FIG. 4A, both lines described by the points of detonation are some distance above the ground plane. Note also that in FIGS. 4A and 4B, the two lines described by the points of detonation define the optimum fuzing surface 42 shown in FIGS. 3 and 4. The two solid lines radiating from each of the eight points of detonation define the centerlines shown in FIGS. 1 and 1A of the lobes of the field-of-view of lens 10; the centerlines subtend an angle of about seventy-five degrees with the trajectories. Ideally, the centerlines shown are about equal to the centerlines of the main lobes shown in FIG. 1 of the fragmentation pattern caused by main charge 24. Examination of FIGS. 4A and 4B reveal that the optimum fuzing surface 42 defined by the trajectories is, at the ground plane, the intersection of the surface of a cone defined by the field-of-view and the ground plane. As the axis of the cone is oblique to the ground plane, the optimum fuzing surface 42 for a salvo of projectiles transversing randomly chosen trajectories intersects the ground plane along a line oblique to the trajectories and to the direction of travel. Further examination of FIGS. 4A and 4B reveal that the lines described by the points of detonation P, Q, R, S and M, N, O, T, are coaxial with one of the centerlines of the field-of-view of the projectiles. In FIGS. 4A, and 4B, when projected upon the ground plane, both of these coaxial lines intersect the designated target 50. This intersection occurs because the optimum fuzing surface for placing the densest part of the fragmentation patter caused by a single projectile at target 50, is a conic surface having its vertex at target 50, its centerline parallel to the centerline of the main lobe of fragmentation burst created by main charge 24, and a greatest central angle equal to the central angle defined by opposite centerlines of the main lobe of the fragmentation burst (i.e., a central angle equal to $2\theta_f$). Detonation occurs when the surfaces of the equal cones defined by the main lobe of the fragmentation burst and the optimum fuzing surface tough along a single line. For the projectiles detonated at points M and P that single line is shown in FIG. 4B as the lower, b, of the two lines radiating from the point of detonation. For each of the remaining points of detonation, that line would be drawn between that point of detonation and the target 50. The points of detonation correspond to that point in the trajectory of the projectile at which the image of the target crosses the inner circumference of photosensitive surface 13 because the angle subtended by the central angle of the field-of-view, $2\theta_1$, is made by choice of design about equal to the central angle subtended by diametrically opposite centerlines of the main lobe of the fragmentation burst, $2\theta_f$. In FIG. 4B, the centerlines of the field-of-view (i.e., which is also approximately the centerline of the main lobe of the fragmentation pattern) closest to the target 50 are shown only for points of detonation M and P as the remaining points of detonation are more distant from the plane of view.

Figure 4C:
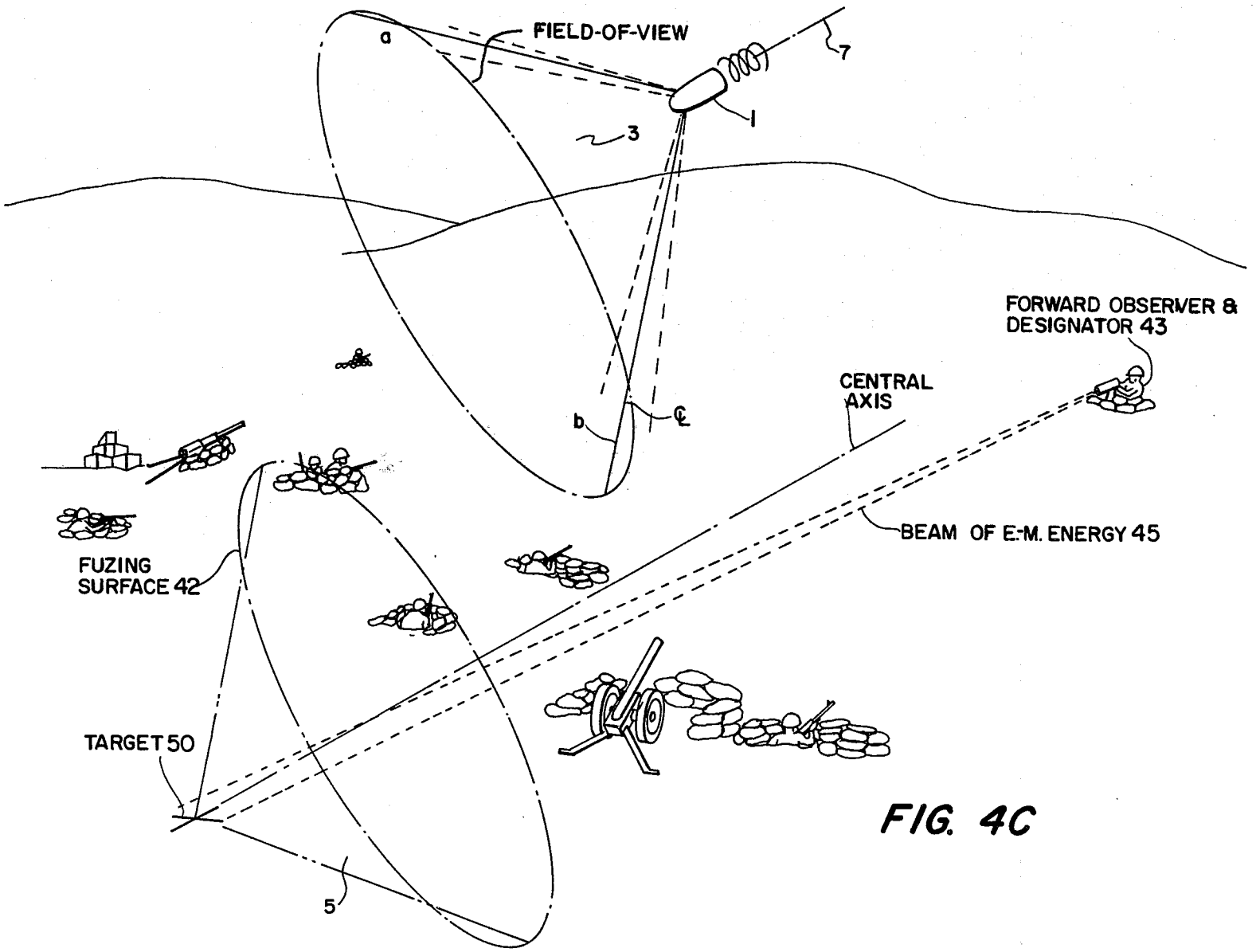
FIG. 4C is a pictorial view of a single projectile used according to the instant invention.

FIG. 4C is a pictorial view of a target plane showing a forward observer 43 projecting a beam of electromagnetic radiation 45 to designate an area 50 of battlefield populated by troops in foxholes. The conic surface 3 of the field-of-view of a spinning projectile 1 is also shown in relation to the optimum conic fuzing surface 5 for that projectile. The vertex of the optimum fuzing surface 5 is coincidental with target 50. The control axis of the optimum fuzing surface 5 is parallel to the trajectory 7 of projectile 1.

Figure 5A:
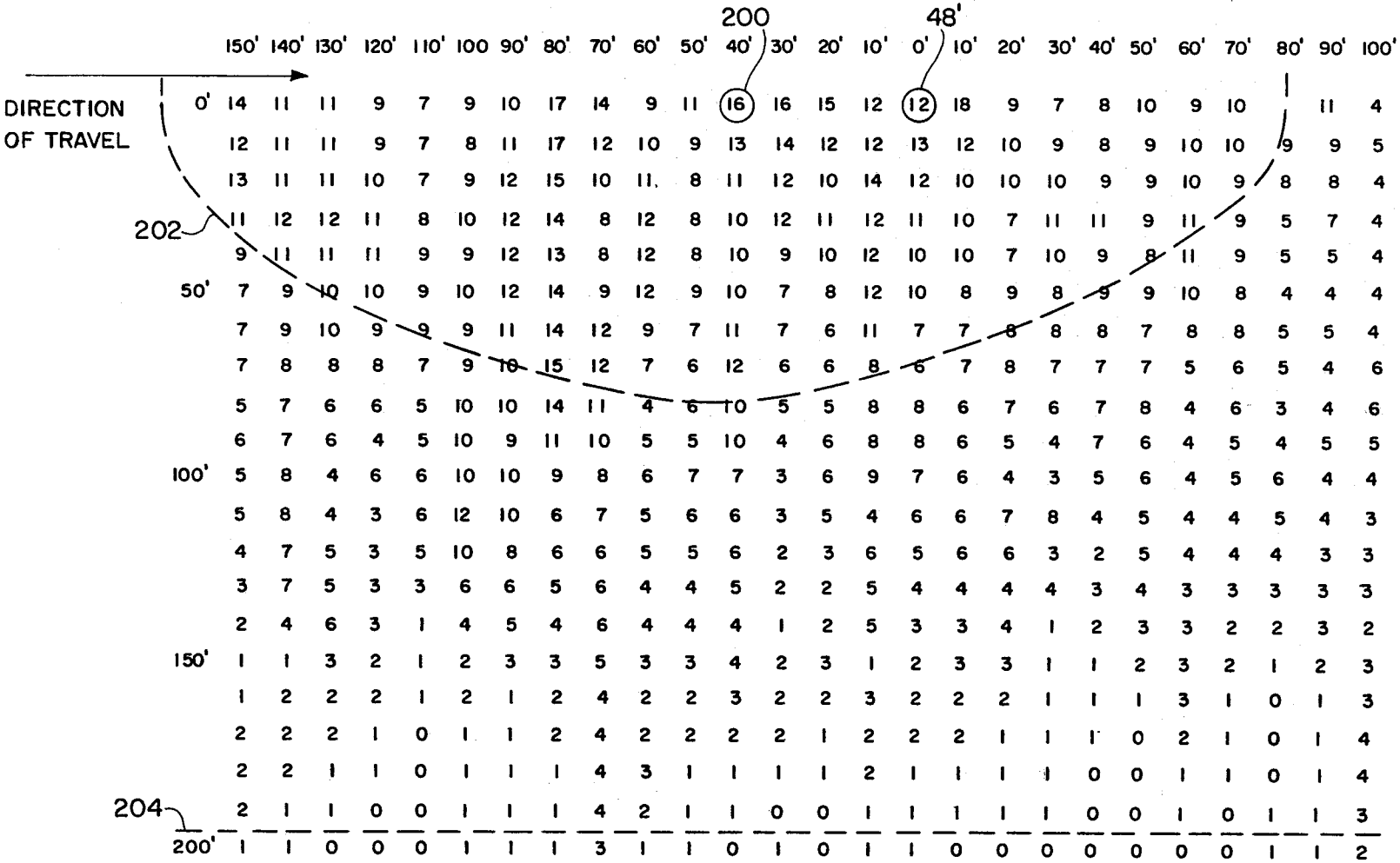
PRIOR ART FIG. 5A
FIG. 5A is a top view showing the average aggregate probability of kill around the east half of a target area shelled by one hundred salvos, each with twenty fragmentation projectiles detonated with prior art proximity fuzes.

Refer now to FIG. 5A, a top view of a fragmentation pattern showing the aggregate probability of kill (i.e., PK %) calculated within each ten foot square zone of the east (i.e., assuming that the direction of travel is to the north) one-half of an area around a nominal point of impact. The half area extends two hundred and fifty feet along the direction of travel of the projectiles by two hundred feet along a normal to the direction of travel. The east one-half describes an almost mirror image of the west one-half of the target area. To calculate the fragmentation pattern, a hypothetical one hundred salvos, each with twenty projectiles detonated by a standard variable time proximity fuze set for a five meter slant range, were assumed to have been launched from a 105 millimeter, M1, COMP. B, howitzer located at a range of seven thousand meters from the nominal point of impact 48'. The target area was assumed to be a level plane. The number shown in each zone of the fragmentation pattern is an average of the number of fragments impacting within the zone in each salvo of twenty projectiles. For the conditions assumed, zone 200 was expected to contain the greatest number of fragments. Over the half area the average aggregate probability of kill varied from a minimum of zero to a maximum of seventeen. The dashed line 202 is approximately the ten percent curve; it defines an elliptical center of the pattern. Within the center the average of the aggregate probabilities of kill is 12.4. The major axis of the ellipse is coaxial with the direction of travel of the projectiles.

Figure 5B:
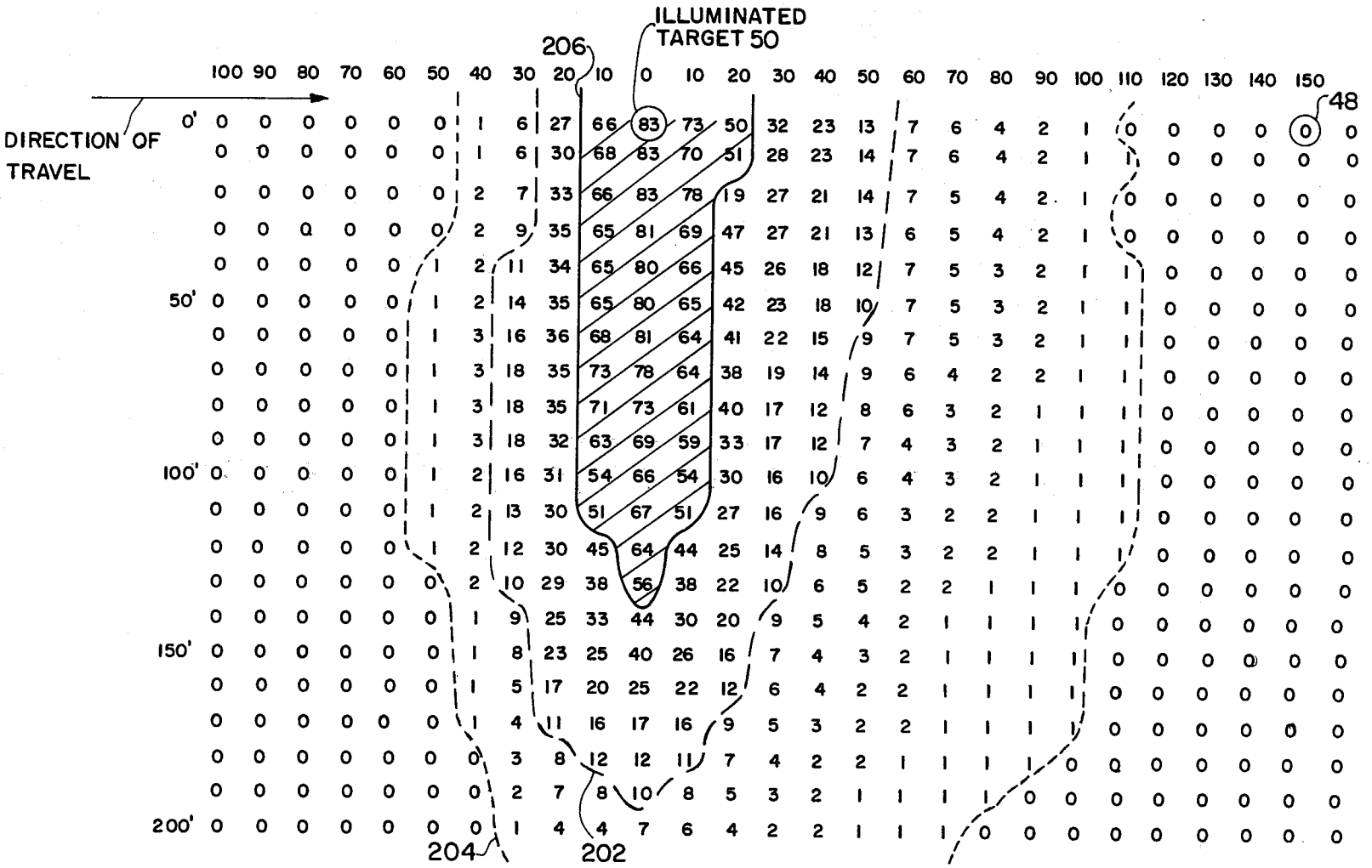
FIG. 5B is a top view showing the aggregate probability of kill around the east half of a target area shelled by twenty fragmentation projectiles detonated with embodiments of the present invention.

FIG. 5B is a top view of a fragmentation pattern showing the aggregate probability of kill calculated within each ten foot square zone of the east (i.e., again assuming that the direction of travel is north) one-half of a area around a target 50 illuminated by a remote source of electromagnetic energy in accordance with the practice of the present invention. The half area partially overlaps the half area shown in FIG. 5A, and measures two hundred fifty feet along the direction of travel by two hundred feet along a normal to the direction of travel. The east half describes an almost mirror image of the west one half of the target area. To calculate the probability of kill, one salvo, equal to the average of a hypothetical one hundred salvos, each with twenty projectiles detonated by a fuze made according to the teachings of the instant invention with a seven degree field-of-view (i.e., $\alpha=7°$), was assumed to have been launched from a 105 millimeter, M1, COMP. B. howitzer located at a range of seven thousand meters from the nominal point of impact 48. The target area, but not the terrain between the howitzer and the target area, was assumed to be a level plane. The number shown in each ten foot square zone is the probability that an object within the zone would be destroyed by a twenty projectile salvo detonated according to the instant invention. The zone containing the illuminated target 50 was expected to have the greatest aggregate probability of kill. Over the half area the values of the aggregate probability of kill varied from a minimum of zero to a maximum of eighty-three; within the approximately elliptical center area defined by the dashed ten percent curve 202 the values varied from ten percent; and within the approximately elliptical inner center area defined by the solid fifty percent curve 206 the values varied from fifty percent to eighty-three percent. Note that the elliptical center conforms to the oblique intersection between the ground plane and the conic surface formed by the main lobes of the fragmentation burst.

There are clear contrasts between the fragmentation patterns illustrated in FIGS. 5A and 5B. The center zone defined by a ten percent curve is, in a salvo detonated according to the prior art, elliptical with the major axis along the flight path of the projectile, while in a salvo detonated according to the instant invention, the center areas are elliptical with the major axis along a normal to the flight path of the projectile. The highest value of the aggregate probability of kill in the prior art pattern is seventeen percent, while in the pattern provided by the instant invention the highest value is eighty-three percent. In the half area of the prior art pattern there are one hundred and twelve zones with an aggregate probability of kill equal to or greater than ten percent, while in the half area of the pattern provided by the instant invention there are one hundred and thirty-four zones with an aggregate probability in the same range. In the prior art pattern no zone has an aggregate probability of kill greater than seventeen percent while the pattern provided by the instant invention there are forty zones with an aggregate probability equal to or greater than fifty percent.

Figure 6:
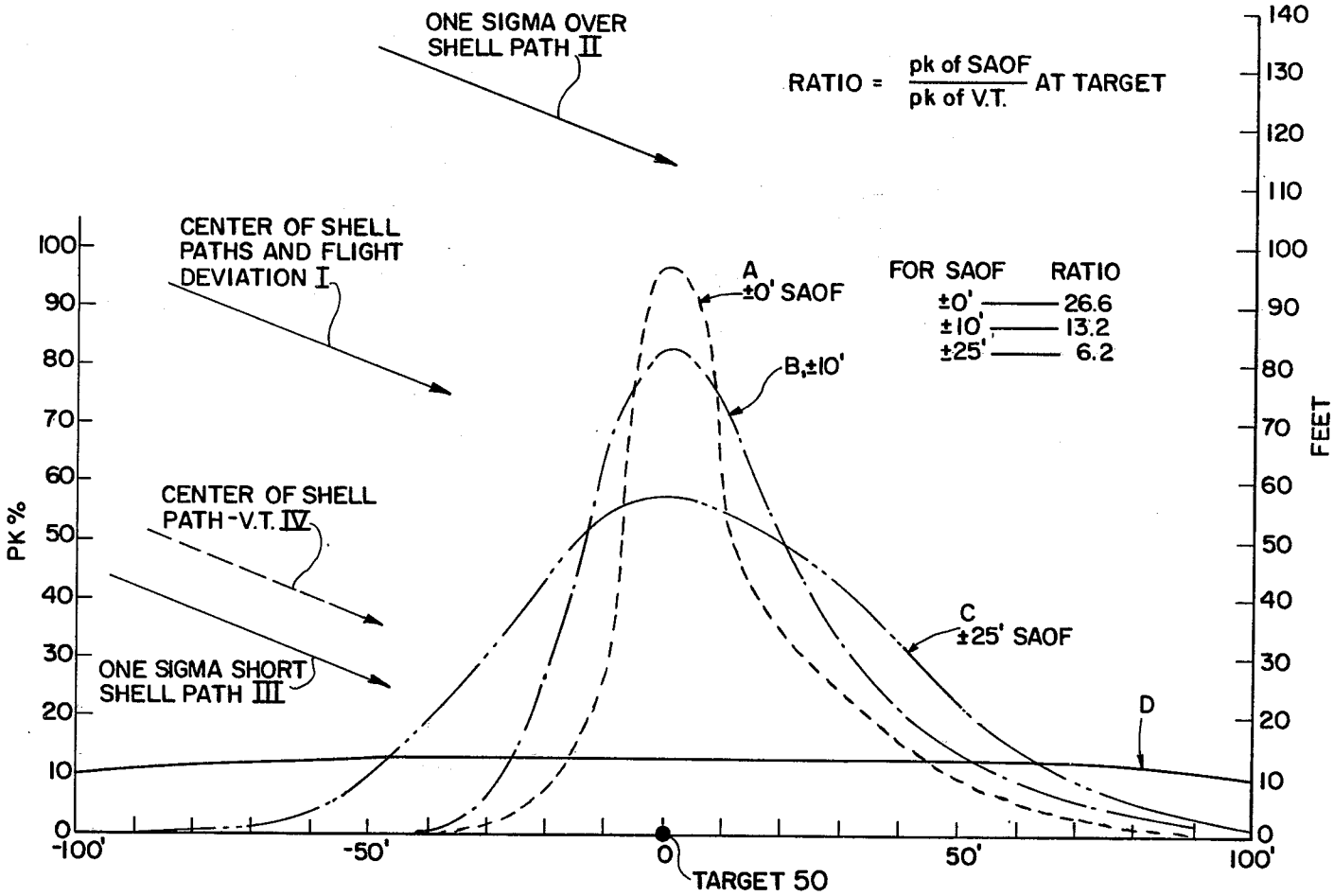
FIG. 6 is a graph showing, in comparison, the aggregate probability of kill as a function of distance along the ground path of four different salvos, each with twenty fragmentation projectiles.

FIG. 6 is a graph illustrating for four salvos of twenty projectiles each, the aggregate probability of kill is sealed on the left ordinate, along a line parallel to the projection of the direction of travel of the projectiles and passing through the target 50. The abscissa represents the projection and is incremented in units of ten feet, centered upon the target. The trajectory I represents the center of the flight paths of the projectiles to be detonated according to the instant invention. Trajectory II represents the flight path of a projectile to be detonated according to the instant invention, that has one sigma of deviation over the center of trajectory I, while trajectory III represents the flight path of a projectile one sigma short of the center of trajectory I. Trajectory IV represents center of the flight path of the projectiles to be detonated with a prior art variable time fuze. The latter projectiles are assumed to have the same deviation from trajectory IV as the projectiles to be detonated according to the instant invention have. Although the projectiles to be detonated with the prior art fuze are, as are the projectiles to be detonated with the present invention, intended to inflict damage and destruction upon an area centered upon target 50, the latter projectiles are launched toward a point of impact farther beyond the target 50 then the point of impact to which the former projectiles are launched. The right ordinate of the graph represents, in increments of ten feet, the altitude of the projectiles above the ground plane.

Curve A represents the aggregate probability of kill calculated for a salvo of twenty projectiles assumed to have been launched with no deviation from the projected direction of travel and detonated according to the instant invention; curve B represents the aggregate probability of kill calculated for the same salvo, but subject to the assumption that the projectiles had been launched with a tolerance allowing for detonation to occur within a ±10 foot standard deviation along the projected direction of travel (i.e., a detonation within ten feet of either side of the optimum fuzing surface); curve C represents the aggregate probability of kill calculated for the same salvo, but with an assumed tolerance allowing for a ±25 foot standard deviation from the projected direction of travel. Curve D represents the aggregate probability of kill calculated for a salvo of twenty projectiles assumed to have been launched with a tolerance allowing for detonation to occur within a ±10 standard deviation along the projected direction of travel, detonated with a prior art variable time proximity fuze, and with the same deviation from the center of the flight path represented by trajectory IV.

Comparison of the aggregate probabilities of kill of the three salvos detonated according to the instant invention with the aggregate probability of kill of the salvo detonated with a prior art variable time fuze illustrates the advantages provided by the instant invention. Curve C, the worst case of the former probabilities because of (i) the assumption allowing deviation from the center of the projectiles' trajectory and (ii) the assumption allowing for a standard deviation of ±25 feet from the projected direction of travel, provides an aggregate probability of kill greater than that of the salvo detonated with prior art fuzes not only at target 50, but for a distance along the projected direction of travel passing through the target 50 that extends from forty-six feet before the target to sixty-three feet beyond the target. At the target, the ratio between the probabilities of kill (i.e., pk %) for individual projectiles fired with the conditions assumed for curve C and curve D is 6.2.

Figure 7:
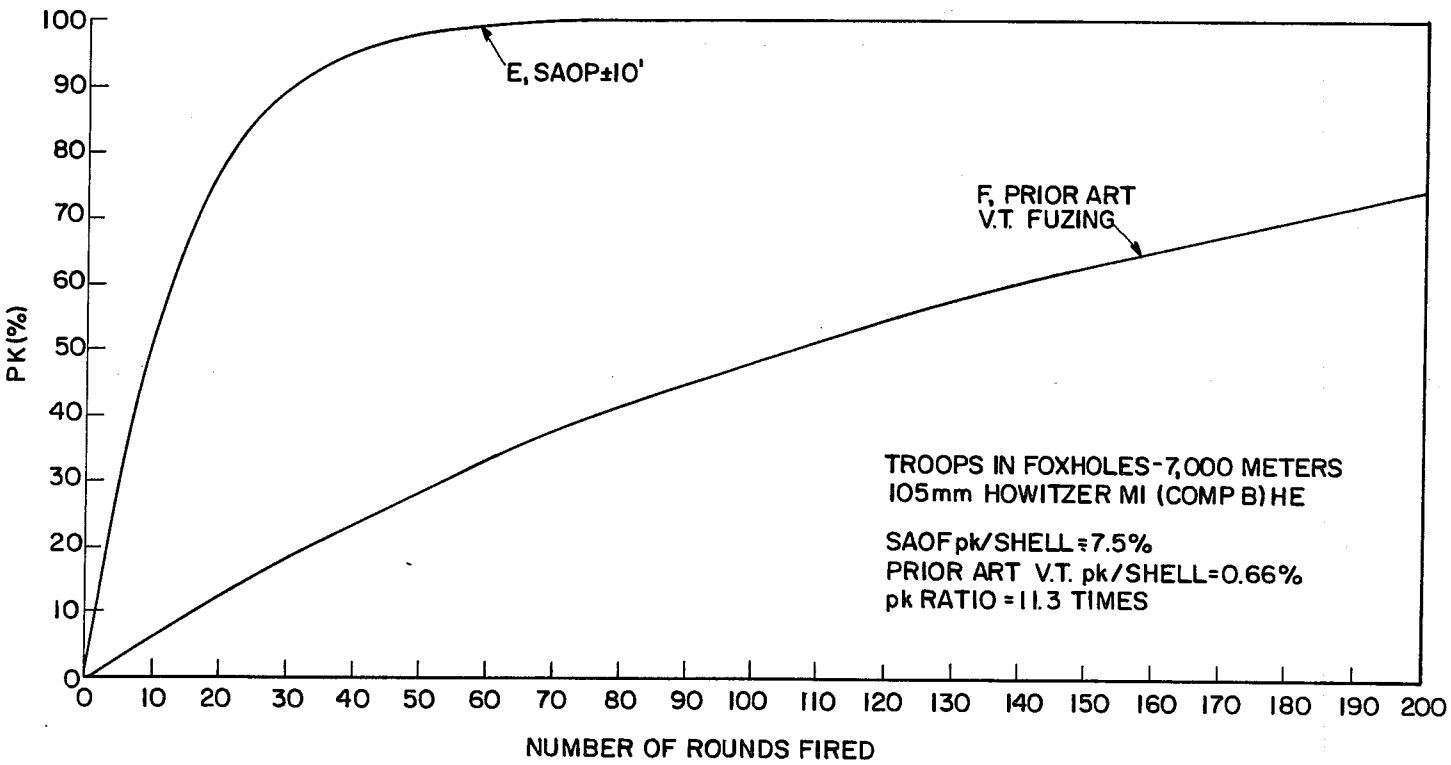
FIG. 7 is a graph showing, in comparison, the aggregate probability of kill as a function of the number of rounds fired, around a target shelled with fragmentation projectiles detonated by conventional proximity fuzes and by embodiments of the present invention.

FIG. 7 is a two coordinate graph illustrating the aggregate probability of kill within a target area having a radius of fifty feet of the target calculated for projectiles detonated with the instant invention, shown by curve E, in comparison with projectiles detonated with prior art variable time proximity fuzes, shown by curve F, as a function of the number of projectiles fired. The tolerance of ±10 feet was assumed for the deviation of the projectiles represented by curve E, the same standard deviation was assumed for the projectiles represented by curve F. All projectiles are launched from a 105 millimeter M1, COMP B, HE, howitzer at a range of seven kilometers at a target area containing troops in foxholes. Ten of the semi-active optically fuzed projectiles provided an aggregate probability of kill in excess of fifty percent in the target area while the same number of variable time proximity fuzed projectiles provided less than eight percent in the same area. The probability of kill for an individual projectile detonated with a semi-active optical fuze under the assumed conditions is 7.5%, 11.3 times the probability of kill for the same projectile launched under the same conditions but detonated with a prior art variable time fuze.

Figure 8:
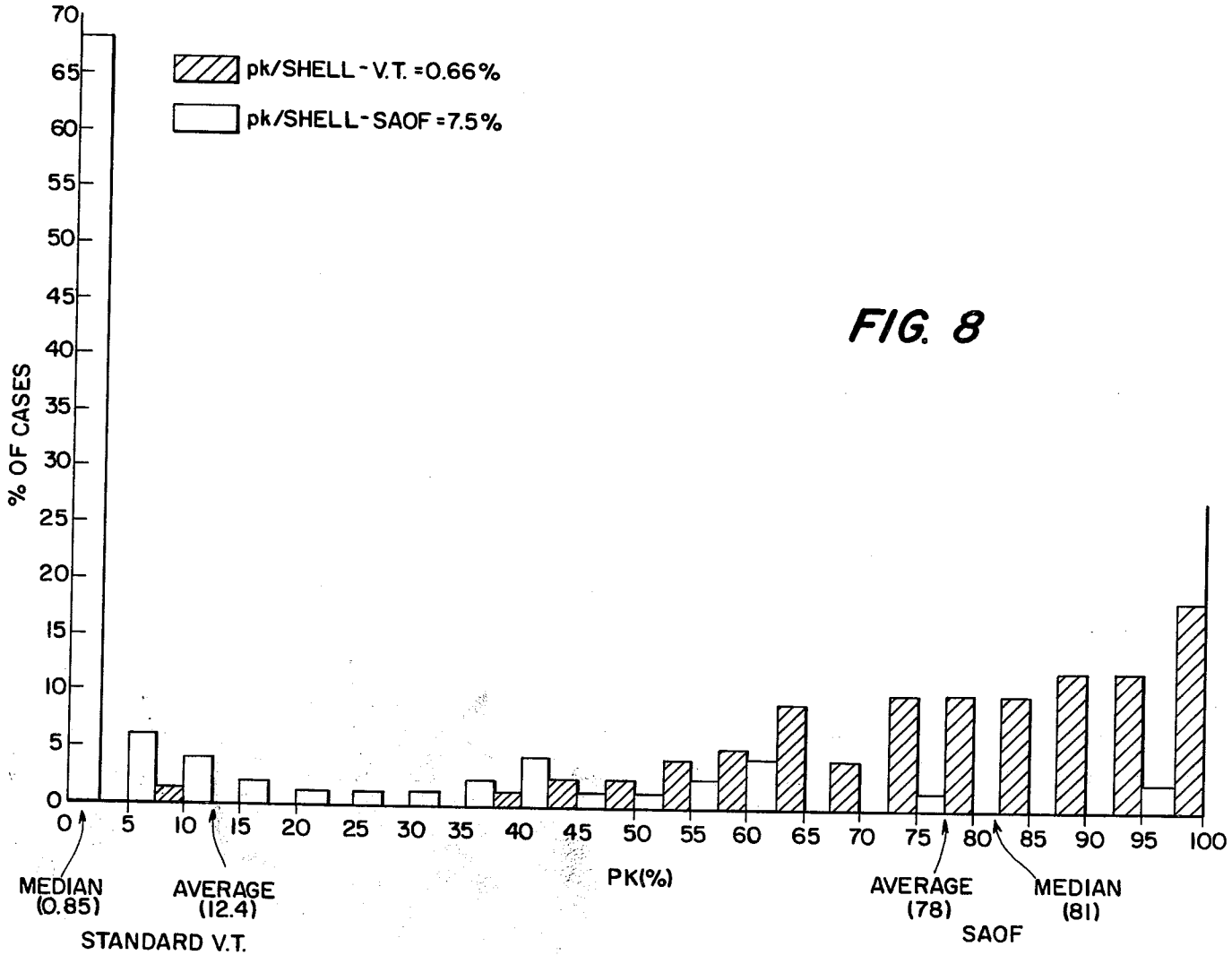
FIG. 8 is a bar graph showing, in comparison, aggregate probability of kill as a function of the percentage of instances in which each five percent increment of aggregate probability of kill was achieved by fragmentation projectiles detonated by prior art fuzes and by embodiments of the instant invention.

FIG. 8 is a bar graph illustrating the aggregate probability of kill calculated in increments of five percent, as a function of the percent of occurrences in which each aggregate probability of kill is achieved by a salvo of twenty projectiles detonated with the semi-active optical fuze in comparison with the same salvo when detonated with prior art variable time proximity fuzes. A tolerance of ±10 feet standard deviation in the position of the projectiles from the optimum fuzing surface was assumed for all projectiles. All projectiles were launched from a 105 millimeter M1, COMP B, HE, howitzer at a range of seven kilometers at a target area containing troops in foxholes. The target area was fifty feet in radius.

A salvo of twenty projectiles detonated with prior art variable time fuzes provided an aggregate probability of kill equal to or greater than fifty percent only in less than fifteen percent of the instances. The same salvo of projectiles detonated with the semi-active optical fuze provides an aggregate probability of kill equal to or greater than fifty percent in more than ninety percent of the instances. The average aggregate probability of kill for a salvo of the former projectiles is 12.4; the median is 0.85. The average for a salvo of the latter projectiles is 78; the median is 81.

Figure 9:
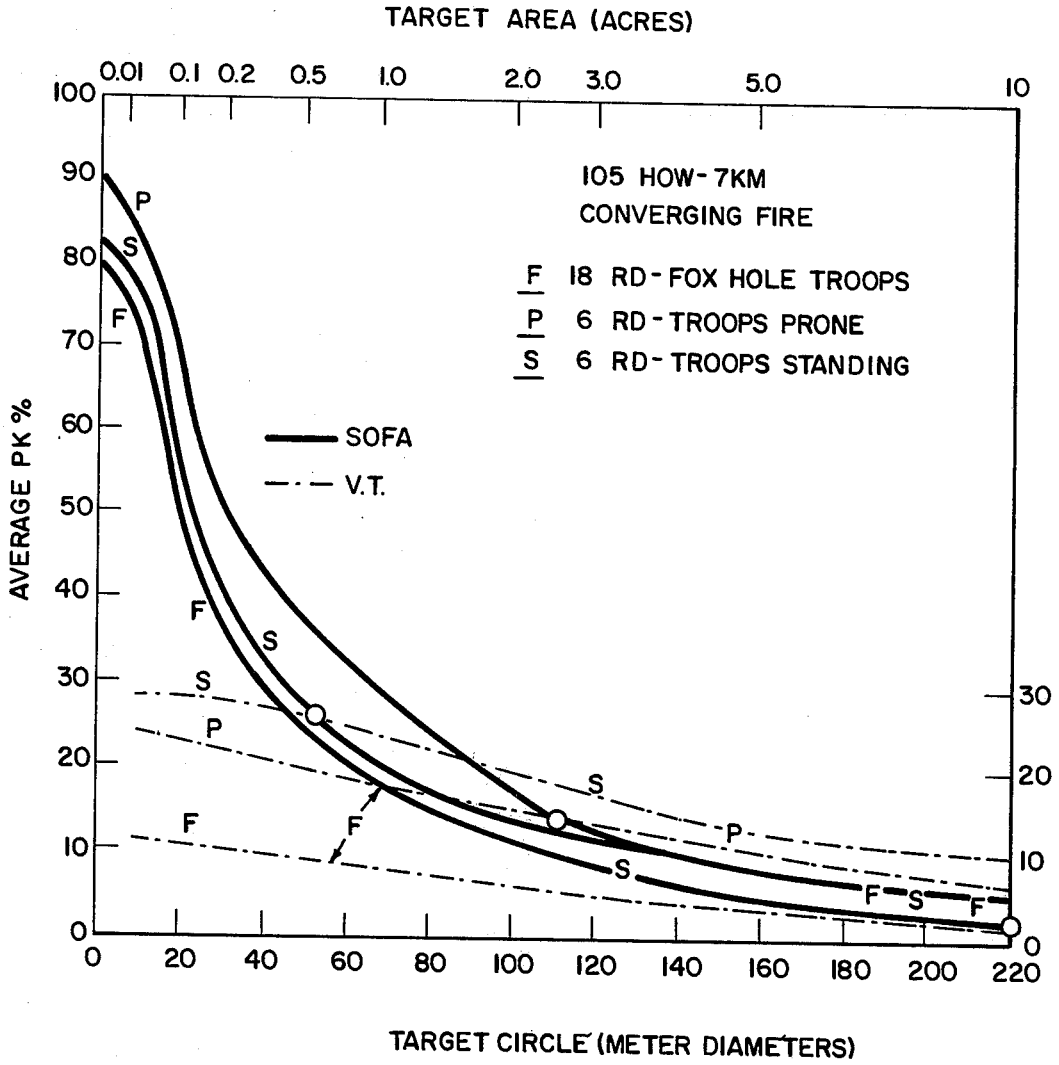
FIG. 9 is a graph showing the aggregate average percent of kill as a function of the diameter of the target, for fragmentation projectiles detonated according to the instant invention in comparison with projectiles detonated according to the prior art.

FIG. 9 is a two coordinate graph showing the aggregate probability of kill calculated as a function of the diameter (on area) of the target for fragmentation projectiles detonated according to the instant invention in comparison with the same type of projectiles detonated according to the prior art. All salvos were assumed to have been launched from a battery of six 105 millimeter M1, COMP B, HE, howitzers positioned at a range of seven kilometers to direct converging fire upon one of three targeted troop deployments.

The advantage of this system is that it combines the ability to use highly sophisticated equipment and human intelligence at the designator station to find and identify a target, with a simple expendable target detector in the projectile. The disclosed fuze is therefore cheap, very versatile, and can be optimumly effective. The resolution required of the projectile lens 10 need not be any greater than that required to compensate for the spatial divergence of the designator beam provided by the more distant laser source 38; consequently, the quality of the lens can be quite low. A fuze of this type can be designed for nearly any type of fragmentation projectile (e.g., shell, bomb, rockets, et cetera) and with the use of a forward designator station will provide over-the-horizon capabilities. Although the examples shown in the illustrations typically show coincidence at detonation between the conic surfaces of the field-of-view and the optimum fuzing surface along the lower centerline, b, of the former, mainly because the target plane is parallel to the earth's surface, coincidence could equally occur along the upper centerline, a, if for example, the designated target 50 is a cave in the side of a steep cliff. The basic fuze design, with only some changes of angle and size, can be used in different projectiles. In this type of system, different weapons can be fuzed by the same designator at the same time in any number. Either the weapon launcher or designator can be sea or airborne, or land emplaced.

Obviously, many modifications and variations of the present invention are possible in light of the above teachings. It is therefore to be understood that within the scope of the appended claims the invention may be practiced otherwise than as specifically described.

What is claimed as new and desired to be secured by Letters Patent of the United States is:

1. A system for fuzing a detonator of a projectile of the type having a longitudinal axis and producing a plurality of fragments within a zone of densest fragmentation, comprising:

designator means for irradiating a target with a beam, the designator coupling to the projectile only via irradiance from the target;

means for fuzing the detonator after reception of irradiance from the target while the projectile is traversing a trajectory terminating at a point beyond the target;

the means including a single detector sensitive to the irradiance within a limited field-of-view, coupled to the detector;

the field-of-view having a central axis coaxial with the longitudinal axis; and the field-of-view being matched to the zone of densest fragmentation.

2. The system set forth in claim 1, wherein the field-of-view describes a first conic surface coinciding with a second conic surface defined by the projected trajectories, at detonation, of the fragments falling within the zone of densest fragmentation.

3. The system set forth in claim 2, wherein the field-of-view includes the trajectory.

4. The system set forth in claim 1, wherein the beam and the trajectory fail to intersect.

5. The system set forth in claim 1, wherein:

the projectile has a forward axis tangential to the trajectory; and the detector has a field-of-view concentric about the forward axis.

6. The system set forth in claim 1, wherein:

the projectile has a forward axis tangential to the trajectory;

the detector includes a converging lens with a principal axis coaxial with the forward axis and normal to the focal plane at a point along the forward axis opposite to the lens from the point of impact; and the detector includes an annular photocell sensitive to the irradiance, positioned concentric with the principal axis on the focal plane.

7. The system of claim 1 wherein said designator means comprises:

telescopic night vision means for allowing an observer optically isolated from said projectile and from the place of launching said projectile to view said target; and laser source means collimated with said night vision means for generating a pulse coded laser beam to illuminate said target.

8. An optical system for fuzing the detonator of a projectile of the type providing a plurality of fragments within a zone of densest fragmentation in an area including a target while traveling a trajectory between a point of launch and a point of impact, comprising:

designator means for projecting illumination upon the target located between the designator and the point of impact;

the target being spaced apart from the point of impact;

the projectile bearing a single detector sensitive to the illumination with a restricted field-of-view, coupled to the detector;

the field-of-view being matched to the zone of densest fragmentation; and the field-of-view being oriented to exclude the point of launch.

9. The system set forth in claim 8, wherein the detector further comprises:

a converging lens having a principal axis and a principal focus; and an electric cell positioned at the focal plane, having a photosensitive surface forming a ring concentric about the principal axis.

10. The system set forth in claim 9, wherein the principal axis is tangential to the trajectory.

11. A semiactive fuzing system, comprising:

a projectile of the type providing a plurality of fragments within a zone of densest fragmentation in an area including a target after traversing at least part of a path extending between a point of launch and a point of impact;

a source emitting radiant energy pulsed according to a code, for illuminating the target;

the projectile carrying a single detector sensitive to the radiant energy within a field-of-view, for generating an output signal pulsed in dependence upon radiant energy reflected from the target;

the field-of-view being matched to the zone of densest fragmentation; and a recognition circuit for generating a firing signal upon an affirmative comparison of the output signal with the selected code.

12. The system set forth in claim 11, wherein the point of impact is spaced apart from the target.

13. The system set forth in claim 11, wherein the point of launch is spaced apart from the source.

14. The system set forth in claim 13, wherein the point of impact is spaced apart from the target.

15. The system set forth in claim 11, wherein the single detector has a field-of-view limited to exclude the point of launch.

16. The system set forth in claim 11, wherein the detector has a field-of-view concentric about a longitudinal axis of the projectile and limited to exclude the point of launch.

17. The system set forth in claim 11, wherein the source couples to the projectile only via radiant energy reflected from the target.

18. The system set forth in claim 11, wherein the source couples to the projectile only via the single detector.

19. The system set forth in claim 11, wherein communication between the source and the single detector occurs only via radiant energy reflected from the target.

20. The system set forth in claim 19, wherein the detector further comprises:

a converging lens having a principal axis and a principal focus; and an annular photocell sensitive to the illumination and coincentric about the principal axis at the principal focus.

21. The system set forth in claim 20, wherein the principal axis is tangential to the path.

22. An optical system for fuzing the detonator of a fragmentation projectile of the type producing a plurality of fragments within a zone of densest fragmentation while traveling between a point of launch and a point of impact, comprising:

designator means for projecting an electromagnetic signal upon a target located between the designator and the point of impact;

the target being spaced apart from the point of impact;

the projectile bearing a single detector sensitive to the electromagnetic signal with a field-of-view restricted to exclude the point of launch;

the field of view being matched in conic surface area to the conic surface described by the potential trajectories at detonation of the fragments falling within the zone of densest fragmentation.

23. The system set forth in claim 22, wherein the point of impact is spaced apart from the target.

24. The system set forth in claim 22, wherein the point of launch in spaced apart from the designator means.

25. The system set forth in claim 24, wherein the point of impact is spaced apart from the target.

26. The system set forth in claim 22, wherein the designator means couples to the projectile only via the electromagnetic signal reflected from the target.

27. The system set forth in claim 22, wherein the designator means communicates with the detonator only via the single detector.

28. The system set forth in claim 22, wherein communication of the electromagnetic signal to the single detector occurs only via reflection of the electromagnetic signal from the target.

29. The system set forth in claim 28, wherein the detector further comprises:

a converging lens having a focal point located along a principal axis; and an electric cell with a photoannular surface sensitive to the electromagnetic signal exposed to the lens concentrically about the principal axis, positioned near the principal focus.

30. The system set forth in claim 29, wherein the principal axis is tangential to the trajectory.

31. An optical system for fuzing the detonator of a fragmentation projectile of the type producing a plurality of fragments within a zone of densest fragmentation and having a potential point of impact, comprising:

designator means for projecting illumination upon a target between and spaced apart from the designator and the point of impact;

the projectile containing a single detector sensitive to the illumination in a restricted field-of-view, coupled to the detonator; and the field-of-view describing a first conic surface equivalent to a second conic surface defined by the projected trajectories at detonation of the fragments falling within the zone of densest fragmentation.

* * * * *